US005182433A

United States Patent [19]

Sakamoto et al.

[11] Patent Number: 5,182,433

[45] Date of Patent: Jan. 26, 1993

[54] METHOD OF LASER QUENCHING

[75] Inventors: Hiroki Sakamoto; Hidenobu Matsuyama; Kimihiro Shibata, all of Yokosuka, Japan

[73] Assignee: Nissan Motor Co., Ltd., Kanagawa, Japan

[21] Appl. No.: 780,500

[22] Filed: Oct. 22, 1991

[30] Foreign Application Priority Data

Dec. 12, 1990 [JP] Japan ..... 2-401506

[51] Int. Cl.[5] ..... B23K 26/00

[52] U.S. Cl. ..... 219/121.85; 219/121.78

[58] Field of Search ..... 219/121.6, 121.85, 121.78

[56] References Cited

U.S. PATENT DOCUMENTS 4,304,978 12/1981 Saunders ..... 219/121.6
4,370,540 1/1983 Davis et al. ..... 219/121.85
4,507,538 3/1985 Brown et al. ..... 219/121.85
4,686,349 8/1987 Kawazu et al. ..... 219/121.65 X
4,739,148 4/1988 Kawazu et al. ..... 219/121.75 X
5,073,212 12/1991 Fröhlich ..... 148/152

*Primary Examiner*—C. L. Albritton

[57] ABSTRACT

A method of laser transformation hardening adapted to irradiate a laser beam in a sense of P polarization on a work piece at an angle of incidence to a surface of the work piece of 60° or more which comprises steps of: forming a plurality of triangular ridges on a horizontal plane adjacent to a surface of the work piece, having a first plurality of inclined surfaces inclined at a first angle to the horizontal plane and a second plurality of inclined surfaces inclined at a second angle to the horizontal plane, the first angle being smaller than the second angle; and irradiating the laser on the work piece at the angle of incidence to the surface of the work piece of 65° to 70° from a direction on the side of the second plurality of inclined surface.

4 Claims, 3 Drawing Sheets

METHOD OF LASER QUENCHING

BACKGROUND OF THE INVENTION

1. Field of the Invention

This invention relates to a method of laser transformation hardening which is utilized in quenching surface of a work piece for improving the property thereof.

2. Discussion of Background

Generally speaking, the absorption coefficient of a metallic material as an object of laser beam machining, is small. Therefore, conventionally, it has been a big problem how to transfer energy of irradiated laser beam to a work piece efficiently, to thereby elevate temperature of the work piece.

This is not exceptional in laser transformation hardening. A method is adopted in which the laser beam is irradiated on the work piece, generally, after a pretreatment is performed such as painting of an absorber on the surface of the work piece, to improve the absorption coefficient of the laser beam on the surface of the work piece. However, in this method, steps of painting and removing the absorber are required.

The absorption coefficient of the laser beam depends on an angle of incidence of the laser beam with respect to the work piece. It is known that the absorption coefficient has its maximum value at Brewster angle inherent in respective material and the wave length of the laser beam.

This is called Brewster effect. It is possible to promote the absorption coefficient of the laser beam by utilizing this effect without applying a coating of the absorber on the surface of the work piece.

FIG. 5 shows the dependency of the absorption coefficient on the angle of incidence of a carbon dioxide laser beam with respect to a ferrous material having considerably smooth surface. The bold line shows the absorption coefficient of the carbon dioxide laser beam when the laser beam is incident on the material in P polarization, and the broken line shows the absorption coefficient when the laser beam is incident on the material in S polarization.

As shown in FIG. 5, the absorption coefficient in P polarization has its maximum value at around the angle of incidence of 85°, when the laser beam is incident on the material in P polarization. The maximum value is more than 10 times as much as the absorption coefficient when the laser beam is transmitted from right above.

FIG. 3 shows that a laser transformation hardening is performed on a ferrous material utilizing Brewster effect. FIG. 4 is a magnified diagram of the essential part in FIG. 3.

In FIGS. 3 and 4, a notation 1 designates a ferrous material test piece which is a work piece, 2, a laser beam, 3, a quench-hardened layer, $\theta$, an angle of incidence of the laser beam 2, and S, a horizontal plane of the work piece.

As shown in FIG. 4, the surface profile of the work piece which is observed microscopically, is a random irregularity. Therefore it is known by experiment that the angle of incidence $\theta$ which maximizes the absorption coefficient of the laser beam 2, is around 79° which is a little lower than the theoretical value.

However, in the conventional method of laser transformation hardening, it is required to position the work piece to be inclined at almost in the neighborhood of 90° with respect to the incident beam. Therefore the irradiated position of the laser beam is considerably deviated by a slight positional deviation of the work piece, which causes the positional deviation of the laser beam.

Furthermore, by the similar cause, the beam shape on the surface of the work piece is considerably changed by the slight deviation of the angle of inclination of the work piece, and the power density of the laser beam is also changed. Therefore it is quite difficult to maintain constant the condition of irradiation, and accordingly the stable laser beam machining can not be performed.

SUMMARY OF THE INVENTION

It is an object of the present invention to solve the above problems such as positional deviation of the laser beam or the change of the power density due to the change of the beam shape.

It is an object of the present invention to provide a method of laser transformation hardening capable of stabilizing laser transformation hardening operation, by making an optimum angle of incidence of the laser beam smaller than the conventional one and thereby making the allowable range of the deviation of the angle of incidence as large as possible.

According to an aspect of the present invention, there is provided a method of laser transformation hardening adapted to irradiate a laser beam in a sense of P polarization on a work piece at an angle of incidence to a surface of the work piece of 60° or more which comprises steps of:

forming a plurality of triangular ridges on a horizontal plane adjacent to a surface of the work piece, having a first plurality of inclined surfaces inclined at a first angle to the horizontal plane and a second plurality of inclined surfaces inclined at a second angle to the horizontal plane, the first angle being smaller than the second angle; and irradiating the laser on the work piece at the angle of incidence to the surface of the work piece of 65° to 70° from a direction on the side of the second plurality of inclined surface.

In this method of laser transformation hardening the first angle is desirable to be 8° to 12°, and the second angle is desirable to be 28° to 36° and a height of the plurality of triangular ridges is desirable to be 8 to 30 μm, whereby a pitch between the plurality of triangular ridges is 50 to 270 μm.

The reason that the angles of inclination of the inclined surfaces of the triangular ridges formed on the surface of the work piece, are specified in the above ranges, is as follows.

When the angles of inclination are smaller than the above values, the obtained effect becomes small. On the other hand, when the angles of inclination are larger than the above values, the ratio of a shadow part of surface in which the laser beam is not irradiated, becomes large, which causes the lowering of the absorption coefficient.

On the other hand, the lower limit of the height of the ridges is determined to be 8 μm. When the lower limit is smaller than 8 μm, clear difference between the invented method of laser transformation hardening and the conventional one can not be obtained by diffraction effect of the laser beam. The upper limit of the height of the ridges is determined to be 30 μm. When it is larger than 30 μm, the surface roughness of the work piece is enlarged, which necessitates the post-machining of the work piece after the laser transformation hardening.

The range of the pitch of the ridges is determined to be in the above range by specifying the height of the ridges and the angles of inclination.

Since the invented method of laser transformation hardening is constructed as above, the optimum angle of incidence of the laser beam becomes an angle smaller than the conventional one and the allowable range of the deviation of the angle of inclination is enlarged. Therefore disadvantage such as the positional deviation of the laser beam or the change of the power density due to the change of the beam shape is alleviated, and the laser transformation hardening operation is stabilized.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the followings, explanation will be given to embodiments of the method of laser transformation hardening according to the present invention, based on the drawings.

Figure 1:
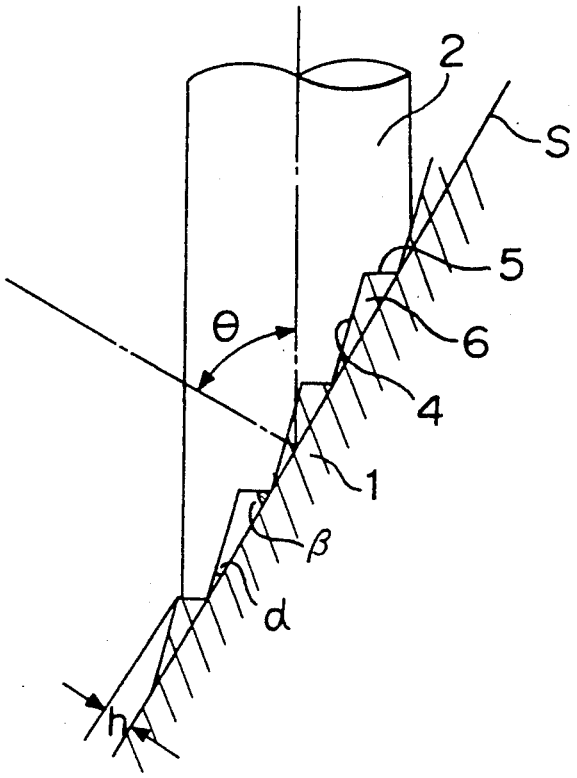
FIG. 1 is an explanatory diagram showing an embodiment of a method of laser transformation hardening according to the present invention.
Figure 3:
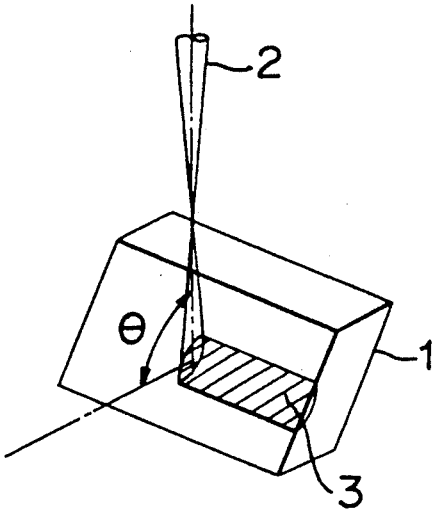
FIG. 3 is an explanatory diagram showing how the laser transformation hardening is performed on a ferrous material utilizing Brewster effect.
Figure 4:
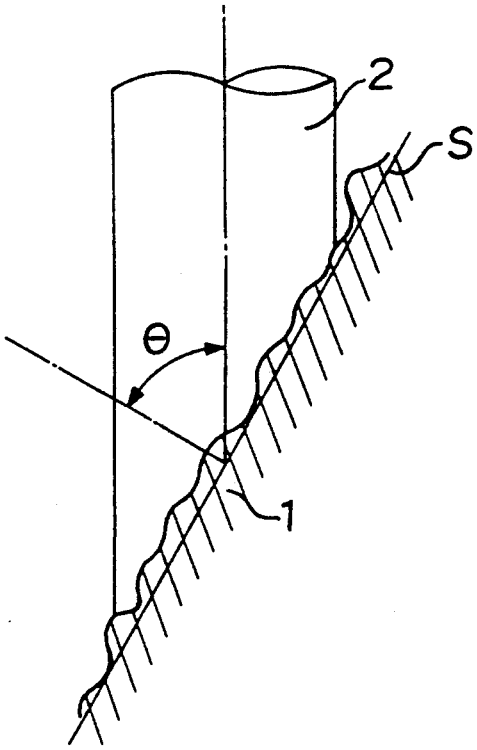
FIG. 4 is a magnified diagram showing an essential part of FIG. 3.
Figure 5:
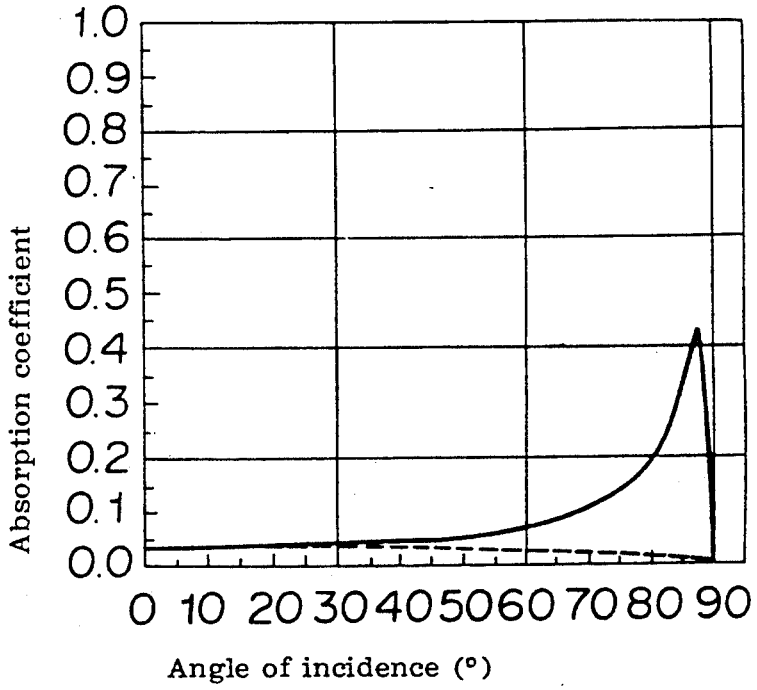
FIG. 5 is an explanatory diagram showing dependency of absorption coefficient on an angle of incidence of a carbon dioxide laser beam on a ferrous material having considerably smooth surface.

FIG. 1 is a magnified diagram of the essential part of FIG. 3 which shows the performance of the laser transformation hardening on the ferrous material utilizing Brewster effect, when the present invention is applied. FIG. 1 corresponds with FIG. 4 in the conventional case. Similar to FIG. 4, a notation 1 designates a ferrous material test piece which is a work piece, 2, a laser beam, $\theta$, an angle of incidence of the laser beam 2, and S, a horizontal plane of the work piece.

FIG. 1 exemplifies the case in which the angle of incidence $\theta$ of the laser beam 2 is set to 70°. A notation 4 in FIG. 1 designates an inclined surface formed with an angle of inclination $\alpha$ of 10° with respect to the horizontal plane S of the work piece, 5, an inclined surface formed with an angle of inclination $\beta$ of 30° with respect to the horizontal plane S of the work piece, and 6, a triangular ridge.

As shown in this embodiment, the angle of incidence $\theta$ of the laser beam 2 is set to 70° with respect to the horizontal plane S of the work piece, and the laser beam 2 is irradiated on the work piece from the direction on the side of the inclined surface 5 which has a larger angle of inclination. In this case, the actual angle of incidence of the laser beam on the inclined surface 4 formed with an angle of inclination $\alpha$ of 10° with respect to the horizontal plane S of the work piece, becomes 80°, and the actual angle of incidence of the laser beam on the inclined surface 5 formed with an angle of inclination $\beta$ of 30°, becomes 40°.

As a result, the absorption coefficient of the laser beam 2 on the inclined surface 5 is decreased. However, the laser beam is irradiated on the inclined surface 4 with an angle of incidence in which the absorption coefficient of the laser beam 2 is increased. Therefore, in total, the absorption coefficient which is equal to or higher than the one in the conventional method, can be obtained by the angle of incidence $\theta$ of the laser beam 2 which is smaller than that in the conventional method.

Figure 2:
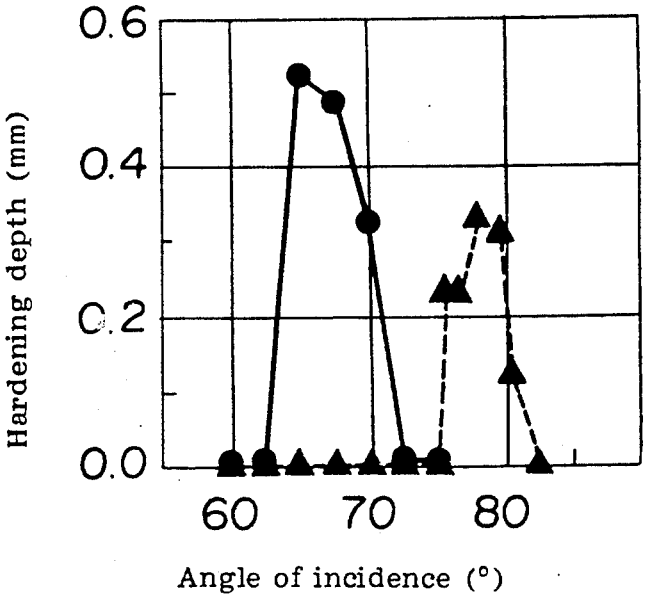
FIG. 2 is a graph showing a relationship between an angle of incidence of the laser beam and a hardening depth of material in cases of the invented method of laser transformation hardening and the conventional method of laser transformation hardening.

FIG. 2 exemplifies the relationship between the angle of incidence and the hardening depth of the material when laser transformation hardening is performed on a low carbon steel by the invented method of laser transformation hardening and by the conventional method of laser transformation hardening. The bold line shows the case by the invented method and the broken line shows the case by the conventional method.

In this case, the output of laser is 1,850 W and the velocity of irradiation of the laser beam 2 is 1.0 m/min.

As apparent in FIG. 2, in this invented method, the optimum angle of irradiation is decreased by about 13° compared with the conventional method, and a larger hardening depth is obtained. Furthermore the range of the angle of the incidence in which an effective hardening depth is obtained, is enlarged to more than 1.5 times as much as that in the conventional method.

A more excellent effect is obtained for the present invention in the range of angle of incidence of 65° to 68°.

As is explained above, according to the present invention, the triangular ridges which have the inclined surfaces with the angle of inclination with respect to the horizontal plane of the work piece of 8° to 12°, and the inclined surfaces with the angle of inclination of 28° to 36° and the height thereof h (refer to FIG. 1) of 8 to 30 μm in the pitch thereof of 50 to 270 μm, are formed on the surface of the work piece. The laser beam is irradiated on the work piece with an angle of incidence of 65° to 70° with respect to the horizontal plane of the work piece from the side of the inclined surfaces which have a larger angle of inclination. Therefore the optimum angle of incidence of the laser beam can be made smaller than the conventional one. As a result, it becomes possible to considerably decrease the positional deviation of the laser beam on the surface of the work piece and the change of the power density due to the change of the beam shape. Accordingly this invention has a considerably excellent effect which enables the stabilized laser transformation hardening.

Obviously, numerous modifications and variations of the present invention are possible in light of the above teachings. It is therefore to be understood that within the scope of the appended claims, the invention may be practiced otherwise than as specifically described herein.

What is claimed is:

1. A method of laser transformation hardening adapted to irradiate a laser beam in a sense of P polarization on a work piece at an angle of incidence to a surface of the work piece of 60° or more which comprises steps of:

forming a plurality of triangular ridges on a horizontal plane adjacent to a surface of the work piece, having a first plurality of inclined surfaces inclined at a first angle to the horizontal plane and a second plurality of inclined surfaces inclined at a second angle to the horizontal plane, the first angle being smaller than the second angle; and irradiating the laser on the work piece at the angle of incidence to the surface of the work piece of 65° to 70° from a direction on the side of the second plurality of inclined surface.

2. The method of laser transformation hardening according to claim 1, wherein the first angle is 8° to 12°, and the second angle is 28° to 36° and a height of the plurality of triangular ridges is 8 to 30 μm, whereby a pitch between the plurality of triangular ridges is 50 to 270 μm.

3. The method of laser transformation hardening according to claim 2, wherein the angle of incidence is 65° to 68°.

4. The method of laser transformation hardening according to claim 1 or claim 2, wherein the surface of the work piece is irradiated by a laser having an output of 1,850 W and a velocity of irradiation of 1.0 m/min.

* * * * *